United States Patent [19]

Despax et al.

[11] Patent Number: 4,625,795

[45] Date of Patent: Dec. 2, 1986

[54] GEOMECHANICAL PROBE FOR A DRILLING WELL

[75] Inventors: Damien M. Despax, Paris; Jean-Pierre H. Martin, Colombes; Francois Gueuret, Voisins le Bretonneux, all of France

[73] Assignee: Compagnie Francaise des Petroles, Paris Cedex, France

[21] Appl. No.: 715,844

[22] Filed: Mar. 25, 1985

[30] Foreign Application Priority Data

Apr. 3, 1984 [FR] France ..... 84 05210

[51] Int. Cl.[4] ..... E21B 47/00

[52] U.S. Cl. ..... 166/66; 166/191; 33/178 F

[58] Field of Search ..... 166/66, 65 R, 64, 250, 166/254, 255, 191; 33/178 E, 178 F, 178 R, 147 K, 147 N, 544; 175/40, 48, 50

[56] References Cited

U.S. PATENT DOCUMENTS

| | | | |
|---|---|---|---|
| 2,235,533 | 3/1941 | Roberts | 33/178 F |
| 2,760,580 | 8/1956 | Johnston | 166/191 |
| 2,979,134 | 4/1961 | Reed et al. | 166/191 |
| 3,436,836 | 4/1969 | Metevia | 33/178 F |
| 3,488,856 | 1/1970 | Wiklund | 33/178 F |
| 3,690,166 | 9/1972 | Grice | 175/50 X |
| 4,230,180 | 10/1980 | Patton et al. | 166/191 X |

*Primary Examiner*—Stephen J. Novosad
*Assistant Examiner*—Thuy M. Bui
*Attorney, Agent, or Firm*—Sughrue, Mion, Zinn, Macpeak and Seas

[57] ABSTRACT

A geomechanical probe for a drilling well comprises a logging box located between two inflatable preventers and including a plurality of tracers movable radially and urged outwards by springs for engaging the well wall. The tracers are mounted on pistons which are received in cylinders and urged radially inwards by springs for retracting the tracers, the pistons being driven outwardly to displace the tracers into working positions abutting the well wall by supply of actuating fluid to the cylinders. The positions of the tracers is determined by differential transformers having cores fixed for radial movement with respective tracers.

The preventers are inflated with pressurised fluid which is supplied thereto along passages in the probe which also supply pressurized fluid to the well space between the preventers to act upon the well wall.

9 Claims, 6 Drawing Figures

GEOMECHANICAL PROBE FOR A DRILLING WELL

This invention relates to a geomechanical probe intended to be introduced into a drilling well for conveying fluid into the well and measuring various fracture parameters therein.

Particularly when an underground reservoir in line with a well is to be fractured, it is desirable to be able to forecast the main geometrical and hydraulic characteristics of the fracture that a particular type of treatment will induce, e.g. the maximum extent of the fracture; the number of different geological strata passed through; the azimuth of the plane containing the fracture; the limitation of the fracture at the wall and roof of the reservoir or, on the contrary, two superimposed deposits made to communicate with one another, etc.

To obtain this information, it is possible to use a digital simulator capable of modelling the behaviour of the injected fluid and the fractured rocks, taking into account all the conditions at the limits. However, this simulator can only provide reliable results if the correct data is entered into it. One of the most difficult parameters to measure is the in situ stress tensor, which largely governs the azimuth of the fracture, the confinement of the fracture by the walls of the reservoir and the speed of percolation of the fracturing fluid into the rock.

Although measurement of certain parameters can be made in the laboratory on rock samples obtained by core sampling, it is very important to supplement them with measurements obtained in situ by means of a probe lowered into the well. Comparisons between the two types of measurement can give valuable information particularly about the existence of fissures in situ. As regards the stress tensor, it may be possible to ascertain it from core-drilled rock samples because these samples retain the memory of the stresses to which they have been subjected, but this method of determination is still only at the research stage.

It would therefore be very useful to be able to carry out accurate measurements in situ by means of a probe lowered into a drilling well.

The devices proposed hitherto are very difficult or even impossible to produce and do not give sufficiently accurate information.

The present invention proposes to fill this gap and accordingly there is provided a geomechanical probe for a drilling well, comprising an elongate body including a pair of inflatable preventers spaced apart along the body for sealing the well, passage means for conveying pressurised fluid to the preventers to inflate said preventers and for delivering pressurised fluid to act upon the well wall between the inflated preventers, and a logging box located between the preventers and including a plurality of tracers distributed around the box, the tracers being movable radially between retracted positions within the box and extended working positions for abutment with the well wall, and means for sensing the positions of the tracers.

The probe of the invention may be of robust construction, but at the same time reliably effective and accurate in operation.

In a preferred embodiment the tracers are urged radially outwards and mounted on radially movable support members. The support members are made in the form of pistons which are arranged in cylinders and are urged inwardly by springs to retract the tracers, the pistons being displaceable outwardly for moving the tracers to the working positions by actuating fluid introduced into the cylinders.

On one side of the logging box along the body, a chamber or so-called hydraulic enclosure may be provided for containing the actuating fluid and housing electrical drive and control means for pressurising the fluid and transmitting the fluid to the cylinders, and on the other side of the logging box an electrical connector may be provided to enable a detachable coupling of an electric cable with the logging box for conducting electrical power and command signals to the probe and for transmitting electrical logging information signals from the probe.

A full understanding of the invention and its advantages may be gained from the following description of a preferred embodiment of the invention with reference to the accompanying drawings wherein.

Figure 1:
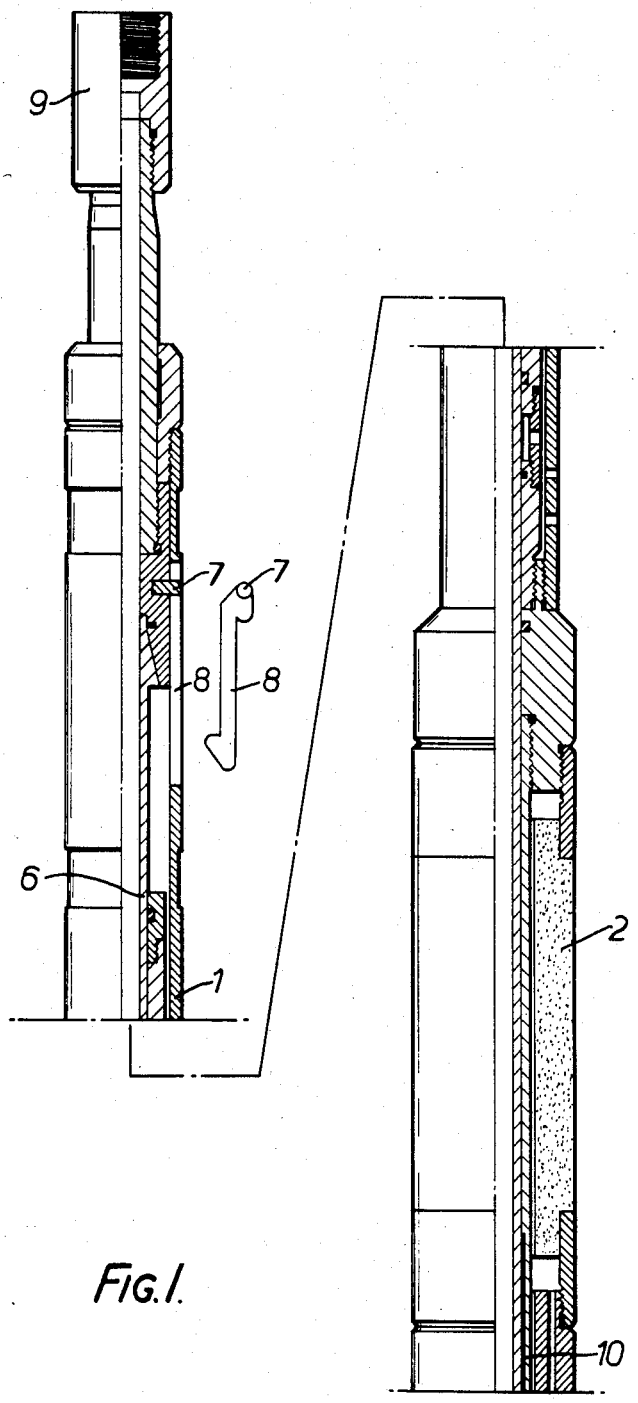
FIGS. 1 and 2 show in elevation and partial section upper and lower portions, respectively, of a geomechanical probe before the inflation of the preventers.

The probe illustrated in FIGS. 1 and 2 and FIGS. 3 and 4 comprises from top to bottom: an upper tubular hollow body 1 carrying an upper inflatable preventer or packer 2, a logging box 3 and a lower tubular hollow body 4 carrying a lower inflatable preventer or packer 5. The upper tubular hollow body is open in the upper part and contains an inner sleeve 6 which can slide inside this hollow body. The sleeve 6 is provided with a stud 7 which engages into a J-shaped groove 8 made in the upper body 1. The profile of the groove 8 has been shown next to FIGS. 1 and 3.

The sleeve 6 is integral in its upper part with a connection piece 9 which makes it possible to fasten it to the bottom of a drill-pipe string, not shown here, used to lower the probe into a drilling well which also has not been shown. The use of a drill-pipe string considerably reduces the risk that it will not be possible to raise the probe if it jams in the well. The drill-pipe string is provided with a slip joint or a constant-force compensation system at the well head.

Figure 2:
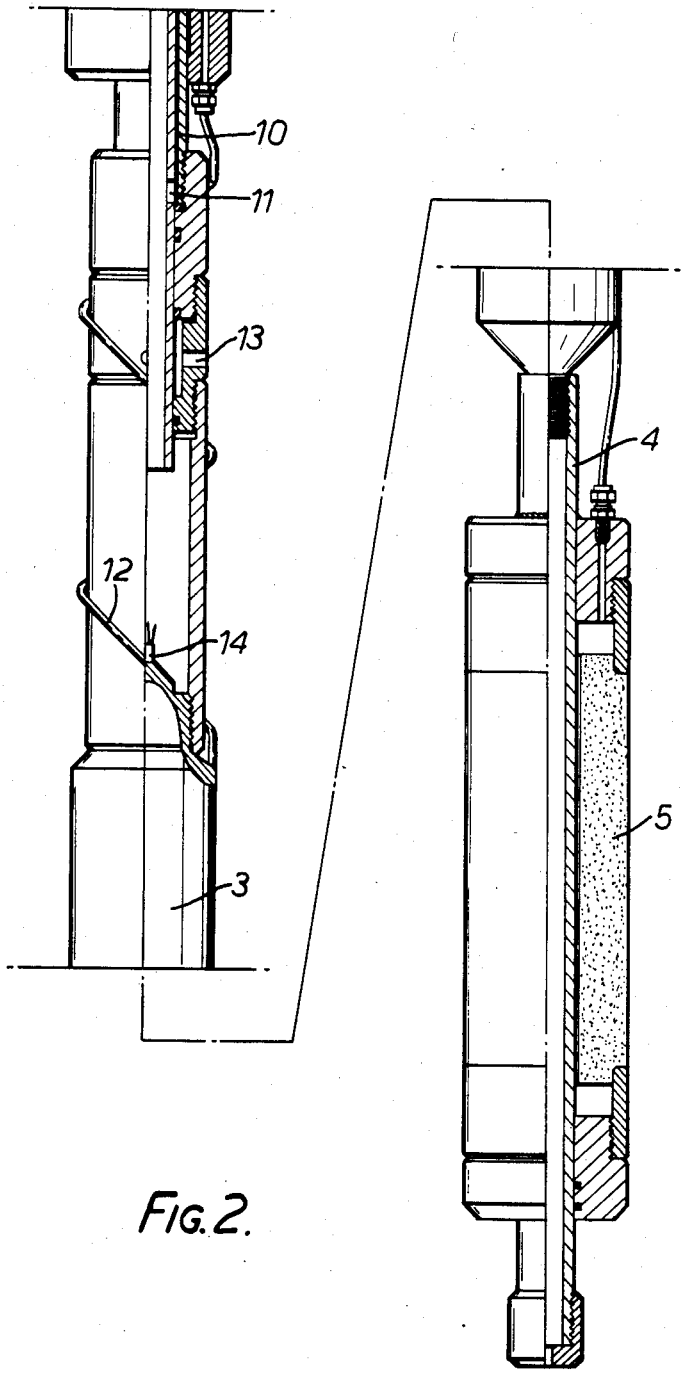

An annular passage 10 has been made in an inner portion of the body 1, to convey a pressurised fluid into the upper inflatable preventer 2. An orifice 11 in the sleeve 6 is located opposite this passage when the sleeve 6 is in the upper position corresponding to the position of the stud 7 in the top of the groove 8, as can be seen in FIGS. 1 and 2, this position being assumed when the probe is lowered on the end of a drill-pipe string. The lower inflatable preventer 5 is in the same state of inflation or deflation as the upper inflatable preventer 2 because of a hydraulic connection 12 between these two preventers 2 and 5.

Figure 3:
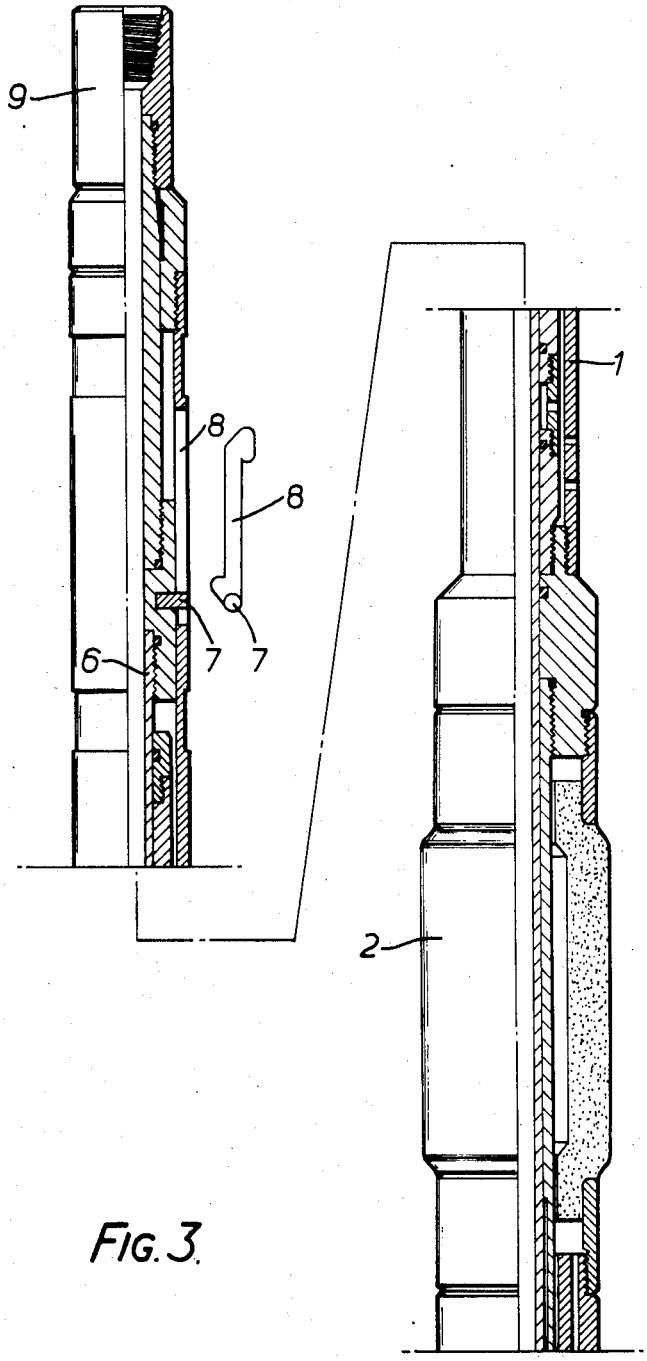
FIGS. 3 and 4 are similar views showing the probe after the inflation of the preventers.
Figure 4:
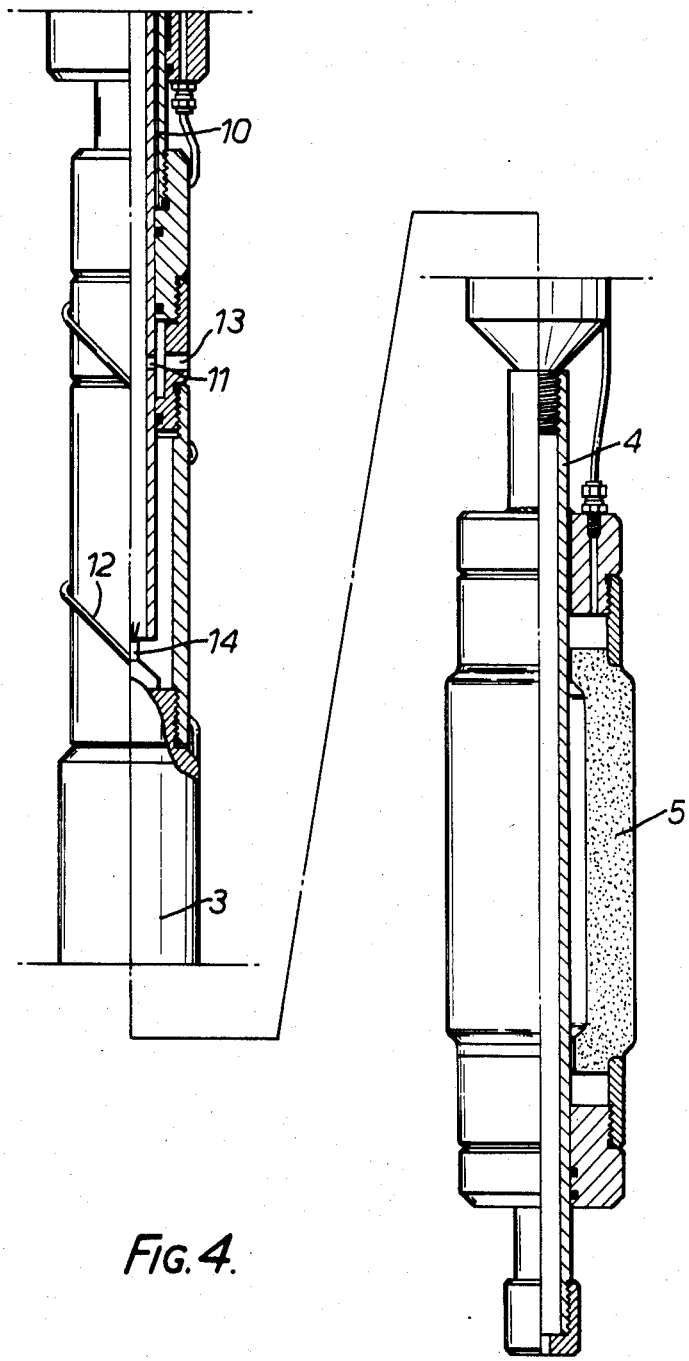

In the upper position of the sleeve 6 illustrated in FIGS. 1 and 2, when a pressurized fluid is conveyed from the well head into the drill-pipe string and the cylindrical volume inside the sleeve 6, it causes the two preventers 2 and 5 to inflate and come up against the inner wall of the well in a leakproof manner. The probe body is then fixed in position in the well, and, as a result of action on the drill-pipe string, the sleeve 6 can be lowered in the body 1, the stud 7 moving to the bottom of the groove 8, as shown in FIGS. 3 and 4. In this lower position of the sleeve 6, the orifice 11 is no longer opposite the passage 10, which is isolated: the preventers 2 and 5 remain inflated. A transverse passage 13 made in the body 1 is then opposite the orifice 11 and allows the pressurised fluid introduced within the sleeve 6 via the drill-pipe string to pass into the annular well space located between the inner wall of the well, the probe body and the two preventers, in order to act on this inner wall of the well.

The box 3 contains various measuring instruments connected to the well head by means of a single electrical conductor which conveys the commands and the measured data by series transmission of the information by means of a multiplexing system. An electrical connection system of the plug-in type, which can be employed in a medium containing particles in suspension, such as a drilling mud, is used above the logging box 3. Such a connection system can be, for example, that developed by Messrs. Deutsch and incorporating lubricant transfer, thus making it suitable for this particular use under highly unusual surrounding conditions. It comprises a connector 14 which is carried by the probe above the box 3 and into which it is possible to plug a matching connector (not shown) lowered inside the drillpipe string, with load bars through which passes an electrical cable fastened to this male connector and which are intended to provide the force necessary for plugging in, for example of the order of approximately 10 kilogrammes.

Figure 5:
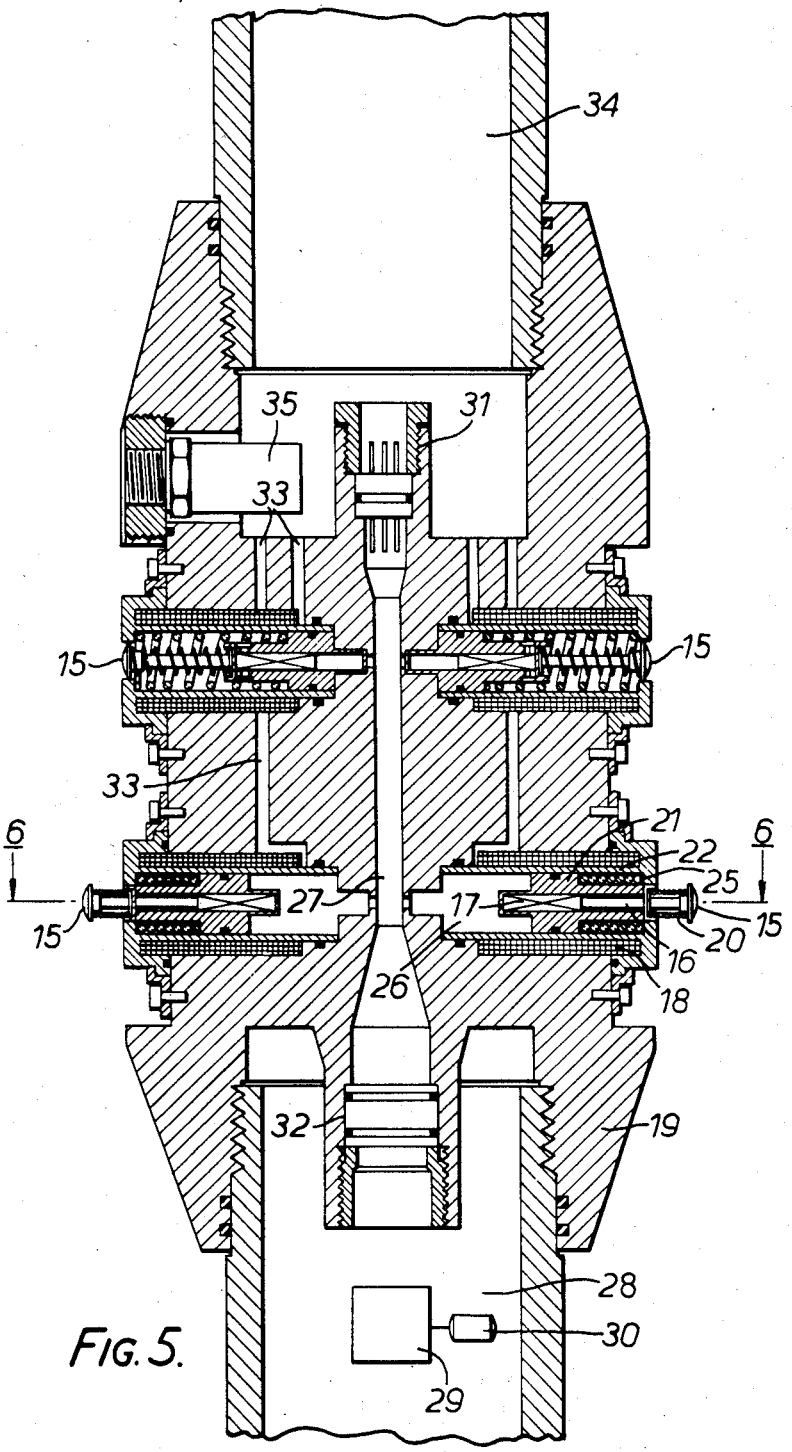
FIG. 5 is a longitudinal section, on a larger scale, of a portion of the logging box, in which the tracers have been brought into the plane of the Figure.
Figure 6:
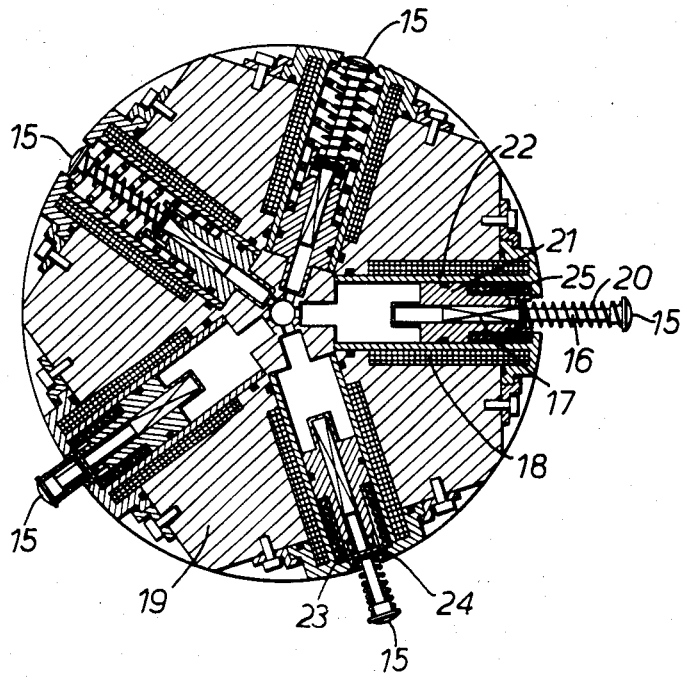
FIG. 6 is a partial cross-section along the line 6—6 of FIG. 5.

FIGS. 5 and 6 essentially illustrate the logging box in the region of the tracers which are arranged to engage against the inner face of the well. These tracers 15 are each integral with a rod 16, the opposite end of which is provided with a core 17 which makes it possible to determine the position of the tracer. In fact, these movable cores 17 interact with fixed windings 18 of differential transformers mounted in a block 19 carrying all the tracers. Each tracer can move radially and is pressed or biassed outwardly by a spring 20 bearing on a displaceable support 21. The profile of the tracers is designed for the desired functions.

Each displaceable support 21 forms the piston of a jack system, the cylinder of which is formed by a titanium sleeve 22 inserted into a cylindrical recess made in the body 19. A filter 23 and a scraper joint 24 are arranged on each supporting piston 21 round the rod 16. The supporting pistons 21, in the state of rest, are brought into a retracted radial position by means of springs 25. In this retracted position, the tracers 15 are retracted inside the block 19. If a pressurised fluid is conveyed into the chamber 26 of the jack formed by the piston 21 and the sleeve 22, the supporting piston 21 is pushed into an advanced radial position, in which the spring 25 is completely compressed, the turns of this spring then being contiguous.

The tracers 15 are arranged in a plurality of transverse planes, two as shown, and they are offset circumferentially from one transverse plane to another transverse plane, contrary to the representation given in FIG. 5 which is modified to show the tracers more clearly.

Pressurised fluid is supplied to the chambers 26 via a central hydraulic duct 27. Under the block 19 there is an enclosure 28 containing hydraulic oil. A pump 29 driven by an electric motor 30 introduces hydraulic oil under pressure into the duct 27 via conduits and solenoid valves not shown. The enclosure 28 can at least partially be arranged radially inside the preventer 5 to reduce the distance between the preventers 2 and 5.

Electrical conductor passages are also made in a leakproof manner in the block 19. In this way, the electric motor 30 is supplied and the solenoid valves of the hydraulic circuit connecting the pump 29 to the duct 27 are controlled. FIG. 5 shows, in particular, an upper sealed passage 31 and a lower sealed passage 32 in the block 19. It also shows ducts 33 for wires connected to the windings 18 of the differential transformers.

Above the block 19 there is an enclosure 34 which is essentially reserved for the electronics. A pressure sensor 35 is shown there, and this measures the pressure at the bottom and can be, for example, of the quartz type or of the type with metal resistance gauges. This enclosure also contains a bearing sensor of the three-component magnetometer type, a platinum resistance temperature sensor, a pressure gauge to measure the pressure in the preventers, and a well-bottom electronic assembly, none of these being shown. All this equipment is connected to the female connector 14, by means of which the connections with a surface electronic assembly are made. The measured data are preferably transmitted with frequency modulation. The surface electronic assembly comprises, in particular, an electrical supply module, a a control-signal generator module, a counter measuring the frequencies representing the physical quantities measured, a computer to reconvert these frequencies into physical quantities, display them on a cathode screen and record them on a magnetic support, and a graphic printer for supplying logging lists and various graphs.

The probe described above can be used as follows.

The probe is lowered into a drilling well by means of a drill-pipe string, the inner sleeve 6 of the probe being in the position of FIGS. 1 and 2 and the preventers 2 and 5 being deflated. When the probe arrives in the vicinity of the formation to be tested, a gamma-ray instrument is lowered inside the drill-pipe string and makes it possible to locate very accurately the position of a bush provided for this purpose and thus adjust the height of the probe in the well. The gamma-ray instrument is subsequently raised, and the preventers 2 and 5 are inflated while a pressurised fluid is injected into the drill-pipe string by means of a surface pump. The gamma-ray instrument could also be incorporated in the probe.

The sleeve 6 is then shifted to bring it into the position shown in FIGS. 3 and 4. The electrical surface-linking cable, equipped with load bars and one of the connectors for plugging the latter piece into the matching connector, is lowered in the drill-pipe string.

An order is transmitted to extend the tracers 15 radially, and information is received at the surface on the shape of the drilling-hole in line with the logging box, the temperature at the bottom of the drilling-hole (making it possible to correct the signals received from the sensors), the position of the probe in relation to the earth's magnetic field, the pressure in the preventers, the pressure of the fluid injected via the probe and the displacements of the well wall. The logging cycle time is of the order of one second. The quantities measured are displayed on a screen and stored in a memory.

The actual test then begins and can take place in the following way: a pressurised fluid is injected into the drill-pipe string under matrix conditions to study the elastic properties of the rock; this fluid is subsequently injected under fracturing conditions, and the azimuth of the fracture is determined; injection is stopped; the stress vector and the percolation speed and determined; the fluid is reinjected, and the surface energy is determined; injection is stopped, and the return to a stable situation is followed.

After this test, the tracers 15 are retracted into the logging box, the sleeve 6 is returned to the position shown in FIGS. 1 and 2 to deflate the preventers 2 and 5, and the probe is shifted to bring it to another level where another test is conducted in a similar way to that described above.

When the last test has been completed, the electrical surface-linking cable is disconnected from the connector 14, and the probe is raised to the surface by means of the drill-pipe string.

This probe, of robust construction, is lowered and raised in a reliable way by means of a train of rods. Electrical connection is made after the probe has been put in position, thus avoiding the risks of destruction of an electrical cable running next to a drill-pipe string during the lowering and raising of the latter. The movement of the tracers is measured with a very high accuracy of the order of one micron, and these tracers do not risk being damaged when the probe is lowered and raised. The various measurements are corrected according to the measured temperature. Furthermore, in the event of fracturing, the fissure produced as a result of hydraulic fracturing is more open than that obtained by means of a diaphragm probe; detection of the main minor stress and of its azimuth is greatly improved. A small volume of fluid produces a very large fissure. The translation of the rock mass perpendicular to the plane of the fracture gives the azimuth of the fracture, and this azimuth can be detected even when the fracture is not a meridian fracture.

This probe is used in tests other than fracturing tests, such as conventional production tests, in which natural fissures and the anisotropy of the permeability of the rock can be determined, and creep tests of the rock, from which the forces exerted on the cemented casings can be deduced.

We claim:

1. A geomechanical probe for a drilling well, comprising an elongate body provided with an inner space adapted to receive pressurised fluid and including:

a pair of inflatable packers longitudinally spaced apart along the body and capable of sealing against the well wall when inflated and defining a closed well space from one packer to the other packer between said body and the well wall;

passage means, extending between said inner space and the inflatable packers and between said inner space and said closed well space, for conveying pressurised fluid successively to said inflatable packers for inflating the same and to said closed well space for acting against the well wall between the inflated packers; and a logging box located between said packers and including a plurality of radially movable tracers distributed circumferentially around said box, said tracers being biased radially outwardly and being mounted on radially movable support members movable between a retracted position in which the tracers are maintained within said box and an extended working position in which the tracers are able to contact the well wall, and sensing means surrounding said tracers for providing signals representative of the radial positions of the respective tracers.

2. A geomechanical probe according to claim 1 wherein the tracers are arranged in at least two groups located in respective parallel transverse planes, the tracers of one group being offset circumferentially relative to tracers of an adjacent group.

3. A geomechanical probe according to claim 1 wherein the means for sensing the positions of the tracers comprise differential transformers having cores fixed for radial movement with respective tracers.

4. A geomechanical probe according to claim 1, wherein the movable support members comprise pistons, the pistons being movable radially in respective cylinders, springs act on the pistons and urge the pistons radially inwardly to retract the tracers, and means is provided for introducing actuating fluid into the cylinders to displace the pistons outwardly for moving the tracers into said working positions.

5. A geomechanical probe according to claim 4, wherein a chamber is provided to one side of the logging box along the body for containing the actuating fluid, electrical drive and control means are accommodated in said chamber for pressurising the fluid and transmitting the fluid to said cylinders and an electrical connector is provided at the other side of the logging box for releasable connection of an electric cable for conducting electrical power and command signals to the probe and for transmitting electrical logging information signals from the probe.

6. A geomechanical probe according to claim 5, wherein the electrical connector is one part of a connector of the two-part plug-in type and suitable for use in a medium containing particles in suspension.

7. A geomechanical probe according to claim 5 or 6, wherein an enclosure is provided and accommodates measuring sensors and an electronic assembly, the logging box includes a support block located between said chamber and said enclosure, the tracers being arranged in said support block, and said electrical connector being arranged in the enclosure at the end thereof remote from the support block.

8. A geomechanical probe for a drilling well, comprising an elongate body provided with an inner space adapted to receive pressurised fluid and inflatable packers longitudinally spaced apart along the body, means communicating between said inner space and said packers for conveying pressurised fluid to the packers to inflate the packers for said packers to engage and seal against the surrounding well wall, means communicating between said inner space and the exterior of the probe at a position between the packers for delivering pressurised fluid into the well to act on the well wall between the inflated packers, and a logging box positioned between the packers and including a plurality of tracers distributed around the box, the tracers being carried by respective pistons movable radially of the probe and received in respective cylinders, the tracers being movable radially with respect to the pistons and urged outwardly relative thereto by first spring means, second spring means acting on the pistons to urge the pistons inwardly to retracted positions for maintaining the tracers within the logging box, means for supplying actuating fluid to the cylinders to displace the pistons outwardly to working positions to enable the tracers to contact the well wall under the action of said first spring means, and sensing means surrounding said tracers for providing signals representative of the positions of the respective tracers, the tracers being arranged in at least two groups located in respective transverse planes with the tracers of one of said groups being offset circumferentially relative to the tracers of an adjacent group.

9. A geomechanical probe according to claim 1 or 8 wherein each of said packers extends completely circumferentially around said body.

* * * * *